US009761384B2

(12) United States Patent
Wu et al.

(10) Patent No.: US 9,761,384 B2
(45) Date of Patent: Sep. 12, 2017

(54) SHIFT ASSEMBLY STRUCTURE OF SWITCH DEVICE

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Wen-Bing Hsu, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 219 days.

(21) Appl. No.: 14/685,765

(22) Filed: Apr. 14, 2015

(65) Prior Publication Data

US 2015/0303658 A1 Oct. 22, 2015

(30) Foreign Application Priority Data

Apr. 16, 2014 (TW) ..... 103113953 A

(51) Int. Cl.
*G05G 5/06* (2006.01)
*H01H 19/04* (2006.01)
(Continued)

(52) U.S. Cl.
CPC ..... *H01H 9/08* (2013.01); *G05G 5/06* (2013.01); *H01H 13/04* (2013.01); *H01H 19/04* (2013.01); *H01H 27/00* (2013.01)

(58) Field of Classification Search
CPC ..... H02B 1/044; H02B 1/048; G05G 5/08; G05G 2700/06; G05G 2700/08;
(Continued)

(56) References Cited

U.S. PATENT DOCUMENTS 7,985,933 B2 * 7/2011 Wu ..... H02B 1/044 200/43.08
8,129,638 B2 * 3/2012 Puri ..... H01H 13/14 200/43.16
D774,460 S * 12/2016 Wu ..... D13/146

FOREIGN PATENT DOCUMENTS

CN 204067147 U * 12/2014
JP 2010153192 A * 7/2010

OTHER PUBLICATIONS

Machine translation of JP 2010153192 A obtained on Jan. 9, 2017.*
Machine translation of CN 204067147 U obtained on Jan. 9, 2017.*

* cited by examiner

*Primary Examiner* — Adam D Rogers
(74) *Attorney, Agent, or Firm* — Rosenberg, Klein & Lee

(57) ABSTRACT

A shift assembly structure of switch device includes a connection seat formed with an assembling hole for rotatably connecting with a main body. A latch section is disposed on the bottom of the connection seat for latching and assembling with a wire-connection module. The connection seat has an arm protruding from the connection seat and an (elastic) restriction section formed on the arm. A shift body is assembled in the connection seat. The shift body is formed with a ridge section and a push/press section. When the shift body is moved from a first position to a second position, the ridge section is permitted to directly pass through the restriction section into a locked state. After the push/press section pushes the restriction section, the main body is unlocked from the connection seat, whereby the assembly of the main body and the connection seat is controllable.

24 Claims, 4 Drawing Sheets

(51) Int. Cl.
*H01H 9/08* (2006.01)
*H01H 13/04* (2006.01)
*H01H 27/00* (2006.01)

(58) Field of Classification Search
CPC ..... H01H 9/08; H01H 13/04; H01H 13/08; H01H 13/12; H01H 13/14; H01H 19/04; H01H 27/00
See application file for complete search history.

SHIFT ASSEMBLY STRUCTURE OF SWITCH DEVICE

BACKGROUND OF THE INVENTION

1. Field of the Invention

The present invention relates generally to a shift assembly structure of switch device, and more particularly to a switch device, in which the main body can be easily and conveniently installed onto or uninstalled from the connection seat.

2. Description of the Related Art

A conventional switch or switch indication device is applied to an electrical, electronic and automatic control system for an operator to operate or power on/off the system on the console. Such switch device includes an operation section equipped with a pushbutton or rotary switch and a main body receiving the operation section, (which is generally referred to as the operation section main body). The main body is passed through an assembling hole of a connection seat. The wall of the assembling hole is formed with multiple insertion blocks. The main body is formed with multiple channels corresponding to the insertion blocks. After the main body is passed through the assembling hole, the insertion blocks are inlaid in the channels to assemble the main body with the connection seat. A latch section is disposed on the bottom of the connection seat for latching with multiple wire-connection modules, which are side by side arranged. In the wire-connection module are mounted electrical contacts and wire-connection component for electrically connecting with wires. An operator can operate the operation section to drive the wire-connection component to control powering on/off of the electrical contacts.

In order to ensure that the main body is securely assembled with the connection seat and truly locked without easy detachment, various conventional locking structures have been disclosed to achieve this object. For example, a push board is disposed on the connection seat. By means of pushing/pressing the push board, the locking and unlocking (or uninstallation) between the main body and the connection seat can be controlled. In general, such push board must be assembled with the connection seat in cooperation with a spring. Therefore, the assembling process is relatively troublesome.

There is also a conventional locking structure employing a rotary mechanism for achieving the locking and uninstallation effect. In this structure, the connection seat has a rotary board in the form of an annular body. The rotary board has a protruding arm and an insertion section formed on the protruding arm. The connection seat has a casing section and a stop section formed on the casing section. When the protruding arm is positioned in the casing section of the connection seat, the insertion section is inserted on the stop section to prevent the rotary board from rotating in a locked state. When an operator wants to release the locked state, the operator needs to use and insert a flathead screwdriver or the like tool between the protruding arm and the casing section to push/press the protruding arm and force the insertion section of the protruding arm to detach from the stop section. Under such circumstance, the operator can operate and rotate the rotary board to the other end of the casing section, permitting the main body to separate from the connection seat to unlock the operation section main body. Reversely, when it is attempted to move the rotary board back to the locked position, the operator must forcedly pull the protruding arm to insert the insertion section into the stop section.

As known by those who are skilled in this field, the above locking structure is characterized in that the motional range of the protruding arm is limited within the interior of the casing section. Only in this case, when the operator forcedly operates the screwdriver or the like tool, the cooperative structures of the protruding arm and the casing section will not be damaged and the locked position of the connection seat and the rotary board will not be easily changed to cause poor operation of the entire switch device. Moreover, in the above locking structure, when operating the rotary board into the locked state or the unlocked state, it is necessary to operate the screwdriver or the like tool or forcedly pull the protruding arm for inserting the insertion section into the stop section or detaching the insertion section from the stop section. Such operation is troublesome and not what we expect.

To speak representatively, the above reveals some shortcomings existing in the main body and connection seat and the relevant connection components of the conventional switch device in use and structural design. In case the assembling structures, the locking system and the application state of the connection seat and the relevant components are redesigned to be different from the conventional switch device, the use form of the switch device can be changed to widen the application range thereof. For example, in the condition that the structure is simplified and the operation is facilitated, the shortcomings of the conventional switch device that the structure is complicated and it is necessary for an operator to troublesome use a tool to install/uninstall the switch device. It is therefore tried by the applicant to provide a shift assembly structure of switch device to eliminate the above shortcomings existing in the conventional switch device.

SUMMARY OF THE INVENTION

It is therefore a primary object of the present invention to provide a shift assembly structure of switch device. The shift assembly structure of switch device is advantageous in that the structure is simplified and the operation is facilitated. The shift assembly structure of switch device includes a connection seat formed with an assembling hole for rotatably connecting with a main body. A latch section is disposed on the bottom of the connection seat for latching and assembling with a wire-connection module. The connection seat has an arm protruding from the connection seat and an (elastic) restriction section formed on the arm. A shift body is assembled in the connection seat. The shift body is formed with a ridge section and a push/press section. When the shift body is moved from a first position to a second position, the ridge section is permitted to directly pass through the restriction section into a locked state. After the push/press section pushes the restriction section, the main body is unlocked from the connection seat, whereby the assembly of the main body and the connection seat is controllable. The shift assembly structure of switch device overcomes the problems existing in the conventional switch device that the structure is complicated and the installation/uninstallation operation of the switch device is troublesome.

In the above shift assembly structure of switch device, the shift body has an inclined face. The height of the inclined face is lower than the height of the ridge section. The restriction section of the connection seat has an inclined section. The inclined section has a stop wall formed at free end of the inclined section. When the shift body is moved from a first position to a second position, the ridge section passes through the inclined section of the restriction section to be stopped by the stop wall into a locked state. At the same time, the inclined section of the connection seat is in contact with the inclined face of the shift body.

When an operator operates the push/press section to push the restriction section, the inclined face of the shift body pushes the inclined section to a set position (or horizontal position) to force the stop wall to leave the ridge section, permitting the shift body to move from the second position back to the first position into an unlocked (or uninstalled) state. Under such circumstance, the operation section main body can be detached from the connection seat.

The present invention can be best understood through the following description and accompanying drawings, wherein:

DETAILED DESCRIPTION OF THE PREFERRED EMBODIMENTS

Figure 1:
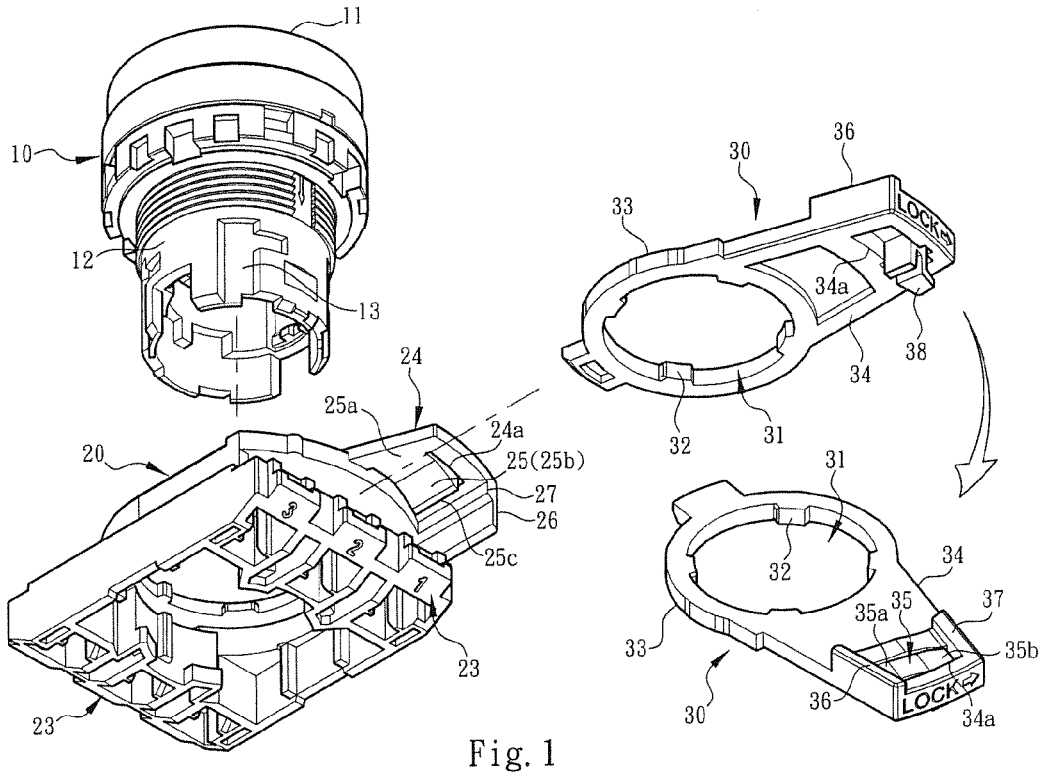
FIG. 1 is a perspective view of the switch device of the present invention, showing the structures of the main body, the connection seat and the shift body of the switch device.
Figure 2:
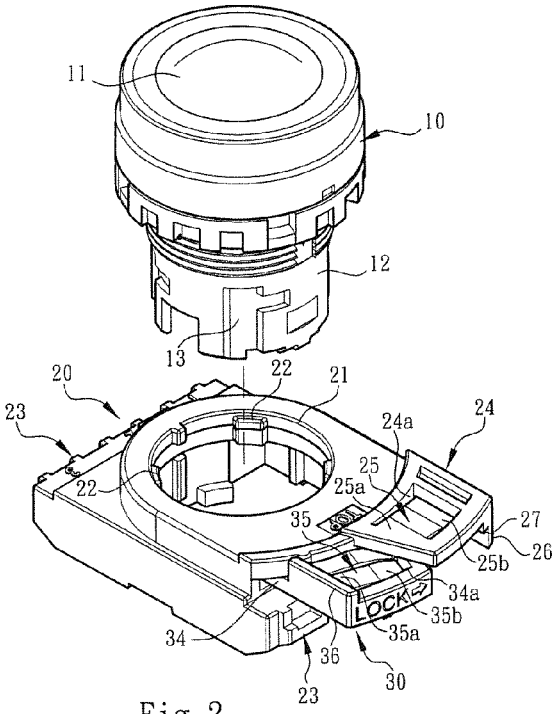
FIG. 2 is a perspective assembled view of the switch device of the present invention, showing the cooperation between the connection seat and the shift body, in which the shift body is positioned in an unlocking position or uninstallation state.
Figure 3:
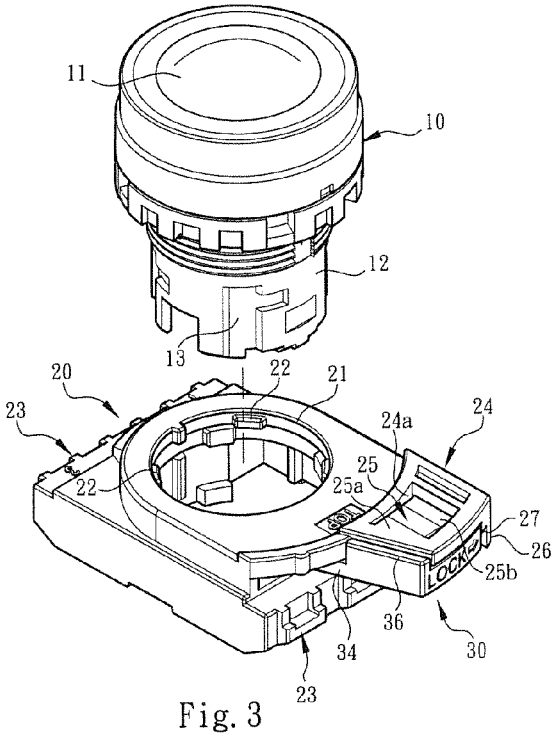
FIG. 3 is a perspective assembled view of the switch device of the present invention, showing the cooperation between the connection seat and the shift body, in which the shift body is positioned in a locking position.

Please refer to FIGS. 1, 2 and 3. The shift assembly structure of switch device of the present invention is a pushbutton or rotary switch device for illustration purposes. The switch device includes a main body 10. The main body 10 receives therein an operation section 11 for an operator to press or rotate so as to control switching on/off of the switch device. The main body 10 has a shaft section 12 and channels 13 formed on the shaft section 12. The switch device further includes a connection seat 20 formed with an assembling hole 21. The wall of the assembling hole 21 is formed with multiple insertion blocks 22. The shaft section 12 of the main body can pass through the assembling hole 21 of the connection seat 20 with the insertion blocks 22 of the assembling hole 21 positioned in the channels 13 so as to assemble the main body 10 with the connection seat 20.

A latch section 23 is disposed on the bottom of the connection seat 20 for latching with multiple side by side arranged wire-connection modules. In the wire-connection module are mounted electrical contacts and wire-connection component for electrically connecting with wires. An operator can operate the operation section 11 to drive the wire-connection component to control powering on/off of the electrical contacts. (This pertains to prior art and is not shown).

As shown in FIGS. 1, 2 and 3, an arm 24 protrudes from one side of upper section of the connection seat 20. An (elastic) restriction section 25 is formed on the arm 24. To speak more specifically, the arm 24 is formed with a mouth section 24*a* receiving the restriction section 25. The restriction section 25 has a fixed end 25*a* connected with the mouth section 24*a* (or the arm 24) and an inclined section 25*b* formed at free end of the restriction section 25. Accordingly, the inclined section 25*b* of the free end has an elastic motional range. The inclined section 25*b* has a tail end formed with a stop wall 25*c*. The inclined section 25*b* is inclined toward lower side of FIGS. 2 and 3, whereby the height of the inclined section 25*b* is lower than the height (or horizontal position) of the mouth section 24*a*. As shown in the drawings, a sidewall 26 is formed on one side of the arm 24 and a shoulder section 27 is formed on the sidewall 26.

In this embodiment, a shift body 30 is assembled with upper section of the connection seat 20. The shift body 30 includes an annular section 33 defining a perforation 31 and formed with insertion blocks 32. The shift body 30 is further formed with a shift section 34 protruding from the annular section 33 and a mouth section 34*a* formed on the shift section 34 for receiving a push/press section 35. Two sides of the mouth section 34*a* are respectively formed with a stop wall 36 and a ridge section 37.

In a preferred embodiment, the push/press section 35 includes a fixed end 35*a* connected with the stop wall 36 and an inclined face 35*b* formed at free end of the push/press section 35. Therefore, the inclined face 35*b* of the free end has an elastic motional range. The height of the inclined face 35*b* is lower than the height of the ridge section 37. As shown in the drawings, a leg section 38 protrudes from the bottom of the push/press section 35 for an operator's finger to press, whereby the push/press section 35 can push the restriction section 25 to move.

FIG. 2 shows that when the shift body 30 is assembled with the connection seat 20 and the insertion blocks 32 of the perforation 31 are aligned with the insertion blocks 22 of the assembling hole 21, the channels 13 of the main body 10 are permitted to pass through the insertion blocks 22, 32, whereby the main body 10 can be assembled with the connection seat 20. At this time, the shift body is positioned in an unlocking position (or uninstallation position), which is defined as a first position.

FIG. 3 shows that the shift body 30 is operated to move the sidewall 26 of the arm 24. Under such circumstance, the insertion blocks 32 of the perforation 31 are not aligned with the insertion blocks 22 of the assembling hole 21. At this time, the shift body 30 is positioned in a locking position (or installation position), which is defined as a second position.

Figure 4:
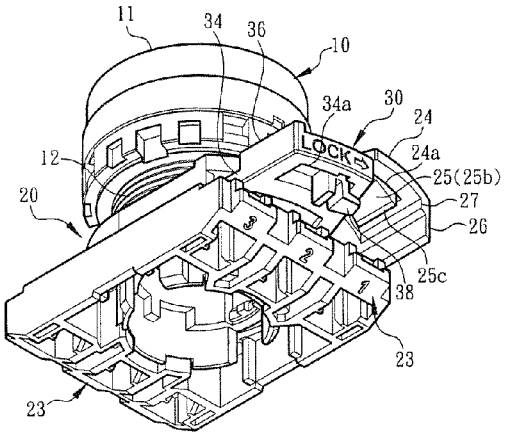
FIG. 4 is another perspective assembled view of the switch device of the present invention, showing the cooperation between the connection seat and the shift body, in which the shift body is positioned in an unlocking position or uninstallation state.
Figure 5:
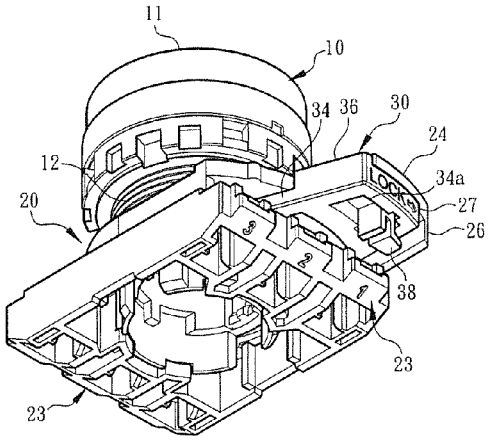
FIG. 5 is another perspective assembled view of the switch device of the present invention, showing the cooperation between the connection seat and the shift body, in which the shift body is positioned in a locking position.
Figure 6:
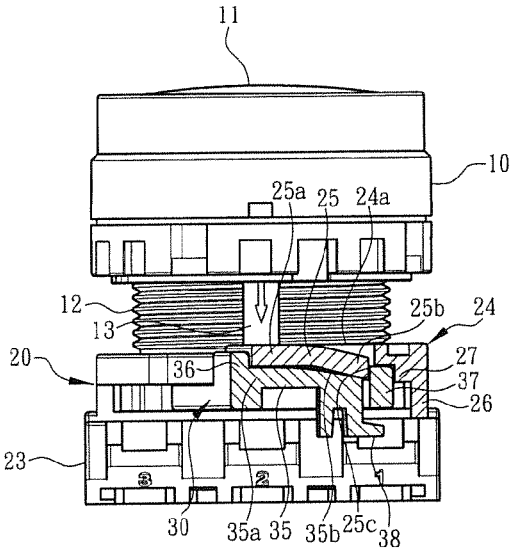
FIG. 6 is a sectional view of the switch device of the present invention, showing that the shift body is positioned in a locking position and the stop wall of the restriction section of the connection seat stops the ridge section of the shift body.

Please refer to FIGS. 4, 5 and 6. When an operator operates the shift body 30 (or the shift section 34) to move from the first position to the second position, the ridge section 37 moves along the restriction section 25 to pass through the inclined section 25*b* into the space defined by the shoulder section 27 and the stop wall 25*c*. Therefore, the ridge section 37 is stopped by the shoulder section 27 and the stop wall 25*c* into a locked state. Also, the stop wall 36 of the shift body 30 reaches the position of the arm 24 to hinder the shift body 30 from further moving. In addition, the inclined section 25*b* of the connection seat 20 is in contact with the inclined face 35*b* of the shift body 30.

Figure 7:
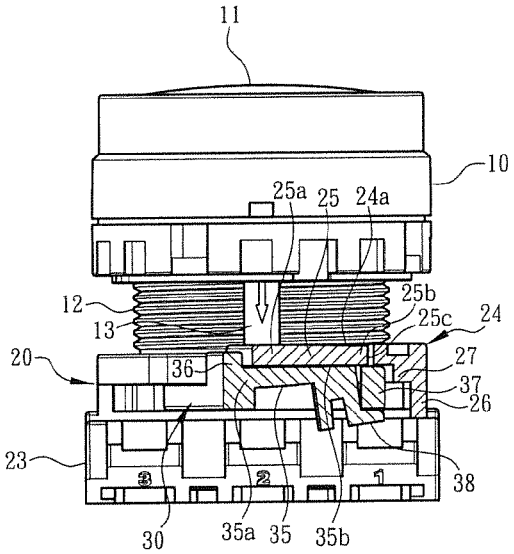
FIG. 7 is another sectional view of the switch device of the present invention, showing that the push/press section of the shift body pushes/presses the restriction section of the connection seat to force the inclined section to move to the horizontal position and make the stop wall leave the ridge section into an unlocked state.

Please refer to FIG. 7. When an operator operates the push/press section 35 to push the restriction section 25, the inclined face 35*b* of the shift body 30 pushes the inclined section 25*b* to a set position (or horizontal position) to force the stop wall 25*c* to leave the ridge section 37, permitting the shift body 30 (or shift section 34) to move from the second position back to the first position into an unlocked (or uninstalled) state. Under such circumstance, the insertion blocks 22 of the assembling hole 21 of the connection seat are aligned with the insertion blocks 32 of the perforation 31 of the shift body 30 again. In this case, the main body 10 can be detached from the connection seat 20.

It should be noted that in the condition that the connection seat 20 and the shift body 30 are truly in the locked state, the inclined section 25*b* of the arm 24 and the inclined face 35*b* of the push/press section 35 are respectively positioned at the free ends, whereby the arm 24 and the push/press section 35 have an elastic motional range. Therefore, without using any tool such as a screwdriver or the like, an operator can quickly operate the shift body 30 and the connection seat 20 to together form a locking or unlocking system.

According to the above, in the condition that the structure is simplified and the operation is facilitated, in comparison with the conventional switch device, the shift assembly structure of switch device of the present invention has the following advantages:

1. The connection seat 20, the shift body 30 and the relevant cooperative structures have been redesigned to be different from the conventional switch device and change the usage and operation form thereof. For example, the arm 24 of the connection seat 20 is formed with the mouth section 24*a* to receive the restriction section 25, the inclined section 25*b* and the stop wall 25*c* with elastic motional effect. The shift section 34 is formed with the mouth section 34*a* to receive the push/press section 35 and inclined face 35*b* with elastic motional effect.
2. The cooperative structures of the connection seat 20 and the shift body 30 permit an operator to directly operate the shift body 30 to move from the first position to the second position. Accordingly, the ridge section 37 can move into the space between the stop wall 25*c* and the shoulder section 27 into a locked state. Also, the push/press section 35 can push the inclined section 25*b* to a horizontal position, permitting the shift body 30 to move from the second position back to the first position into an unlocked state. Therefore, the present invention can be conveniently and quickly installed/uninstalled to apparently eliminate the trouble of the conventional switch device that it is necessary to use a tool to operate the switch device.

In conclusion, the shift assembly structure of switch device of the present invention is different from the conventional switch device in space form and is advantageous over the conventional switch device. The shift assembly structure of switch device of the present invention is novel and inventive.

The above embodiments are only used to illustrate the present invention, not intended to limit the scope thereof. Many modifications of the above embodiments can be made without departing from the spirit of the present invention.

What is claimed is:

1. A shift assembly structure of a switch device comprising:

a connection seat formed with an assembling hole for rotatably connecting with a main body, the connection seat having an arm and a restriction section resiliently extending from a portion of the arm; and a shift body assembled with the connection seat, the shift body being movable between a first position and a second position, the shift body being formed with a ridge section and a push/press section, when the shift body is moved from the first position to the second position, the ridge section displaces the restriction section to pass by the restriction section into a locked state, where the restriction section abuts a side of the ridge section, subsequent displacement of the push/press section toward the restriction section displaces the restriction section away from the side of the ridge section to thereby unlock the main body from the connection seat, whereby the installation and uninstallation of the main body and the connection seat are controllable.

2. The shift assembly structure of the switch device as claimed in claim 1, wherein the shift body is assembled with an upper section of the connection seat, the shift body including an annular section, the shift body being further formed with a shift section protruding from the annular section and a mouth section formed on the shift section for receiving the push/press section, two sides of the mouth section of the shift body being respectively formed with the ridge section and a stop wall, the push/press section including a fixed end connected with the stop wall of the shift body and an inclined face formed ata free end of the push/press section, whereby the inclined face of the free end has an elastic motional range, the inclined face having a height lower than a height of the ridge section.

3. The shift assembly structure of the switch device as claimed in claim 2, wherein the main body receives therein an operation section, the main body has a shaft section and channels formed on the shaft section, the assembling hole of the connection seat having a wall formed with multiple insertion blocks, the shaft section of the main body being passable through the assembling hole of the connection seat with the insertion blocks of the assembling hole positioned in the channels so as to assemble the main body with the connection seat, a latch section being disposed on a bottom of the connection seat.

4. The shift assembly structure of the switch device as claimed in claim 1, wherein the main body receives therein an operation section, the main body has a shaft section and channels formed on the shaft section, the assembling hole of the connection seat having a wall formed with multiple insertion blocks, the shaft section of the main body being passable through the assembling hole of the connection seat with the insertion blocks of the assembling hole positioned in the channels so as to assemble the main body with the connection seat, a latch section being disposed on a bottom of the connection seat.

5. The shift assembly structure of the switch device as claimed in claim 1, wherein the arm protrudes from one side of an upper section of the connection seat, the arm being formed with a mouth section receiving the restriction section, the restriction section having a fixed end connected with the mouth section and an inclined section formed at a free end of the restriction section, whereby the inclined section of the free end has an elastic motional range, the inclined section having a tail end formed with a stop wall, a sidewall being formed on one side of the arm, a shoulder section being formed on the sidewall.

6. The shift assembly structure of the switch device as claimed in claim 5, wherein the shift body is assembled with the upper section of the connection seat, the shift body including an annular section, the shift body being further formed with a shift section protruding from the annular section and a mouth section formed on the shift section for receiving the push/press section, two sides of the mouth section of the shift body being respectively formed with the ridge section and a stop wall, the push/press section including a fixed end connected with the stop wall of the shift body and an inclined face formed at a free end of the push/press section, whereby the inclined face of the free end has an elastic motional range, the inclined face having a height lower than a height of the ridge section.

7. The shift assembly structure of the switch device as claimed in claim 6, wherein the annular section defines a perforation formed with multiple insertion blocks, a leg section protruding from a bottom of the push/press section.

8. The shift assembly structure of the switch device as claimed in claim 7, wherein the main body receives therein an operation section, the main body has a shaft section and channels formed on the shaft section, the assembling hole of the connection seat having a wall formed with multiple insertion blocks, the shaft section of the main body being passable through the assembling hole of the connection seat with the insertion blocks of the assembling hole positioned in the channels so as to assemble the main body with the connection seat, a latch section being disposed on a bottom of the connection seat.

9. The shift assembly structure of the switch device as claimed in claim 6, wherein when the shift body is moved from the first position to the second position, the ridge section moves along the restriction section to pass through the inclined section into a space defined by the shoulder section and the stop wall of the arm into the locked state, in which the inclined section of the restriction section is in contact with the inclined face of the shift body.

10. The shift assembly structure of the switch device as claimed in claim 9, wherein the main body receives therein an operation section, the main body has a shaft section and channels formed on the shaft section, the assembling hole of the connection seat having a wall formed with multiple insertion blocks, the shaft section of the main body being passable through the assembling hole of the connection seat with the insertion blocks of the assembling hole positioned in the channels so as to assemble the main body with the connection seat, a latch section being disposed on a bottom of the connection seat.

11. The shift assembly structure of the switch device as claimed in claim 6, wherein when the push/press section the restriction section, the inclined face of the push/press section pushes the inclined section of the restriction section to a horizontal position to force the stop wall of the restriction section to leave the ridge section into an unlocked state.

12. The shift assembly structure of the switch device as claimed in claim 11, wherein the main body receives therein an operation section, the main body has a shaft section and channels formed on the shaft section, the assembling hole of the connection seat having a wall formed with multiple insertion blocks, the shaft section of the main body being passable through the assembling hole of the connection seat with the insertion blocks of the assembling hole positioned in the channels so as to assemble the main body with the connection seat, a latch section being disposed on a bottom of the connection seat.

13. The shift assembly structure of the switch device as claimed in claim 6, wherein the main body receives therein an operation section, the main body has a shaft section and channels formed on the shaft section, the assembling hole of the connection seat having a wall formed with multiple insertion blocks, the shaft section of the main body being passable through the assembling hole of the connection seat with the insertion blocks of the assembling hole positioned in the channels so as to assemble the main body with the connection seat, a latch section being disposed on a bottom of the connection seat.

14. The shift assembly structure of the switch device as claimed in claim 5, wherein the main body receives therein an operation section, the main body has a shaft section and channels formed on the shaft section, the assembling hole of the connection seat having a wall formed with multiple insertion blocks, the shaft section of the main body being passable through the assembling hole of the connection seat with the insertion blocks of the assembling hole positioned in the channels so as to assemble the main body with the connection seat, a latch section being disposed on a bottom of the connection seat.

15. The shift assembly structure of the switch device as claimed in claim 5, wherein the inclined section is inclined in a direction toward the shift body, whereby the inclined section has a height lower than a height of the mouth section.

16. The shift assembly structure of the switch device as claimed in claim 15, wherein the main body receives therein an operation section, the main body has a shaft section and channels formed on the shaft section, the assembling hole of the connection seat having a wall formed with multiple insertion blocks, the shaft section of the main body being passable through the assembling hole of the connection seat with the insertion blocks of the assembling hole positioned in the channels so as to assemble the main body with the connection seat, a latch section being disposed on a bottom of the connection seat.

17. The shift assembly structure of the switch device as claimed in claim 15, wherein the shift body is assembled with an upper section of the connection seat, the shift body including an annular section, the shift body being further formed with a shift section protruding from the annular section and a mouth section formed on the shift section for receiving the push/press section, two sides of the mouth section of the shift body being respectively formed with the ridge section and a stop wall, the push/press section including a fixed end connected with the stop wall of the shift body and an inclined face formed at a free end of the push/press section, whereby the inclined face of the free end has an elastic motional range, the inclined face having a height lower than a height of the ridge section.

18. The shift assembly structure of the switch device as claimed in claim 17, wherein the annular section defines a perforation formed with multiple insertion blocks, a leg section protruding from a bottom of the push/press section.

19. The shift assembly structure of the switch device as claimed in claim 18, wherein the main body receives therein an operation section, the main body has a shaft section and channels formed on the shaft section, the assembling hole of the connection seat having a wall formed with multiple insertion blocks, the shaft section of the main body being passable through the assembling hole of the connection seat with the insertion blocks of the assembling hole positioned in the channels so as to assemble the main body with the connection seat, a latch section being disposed on a bottom of the connection seat.

20. The shift assembly structure of the switch device as claimed in claim 17, wherein when the shift body is moved from the first position to the second position, the ridge section moves along the restriction section to pass through the inclined section into a space defined by the shoulder section and the stop wall of the arm into the locked state, in which the inclined section of the restriction section is in contact with the inclined face of the shift body.

21. The shift assembly structure of the switch device as claimed in claim 20, wherein the main body receives therein an operation section, the main body has a shaft section and channels formed on the shaft section, the assembling hole of the connection seat having a wall formed with multiple insertion blocks, the shaft section of the main body being passable through the assembling hole of the connection seat with the insertion blocks of the assembling hole positioned in the channels so as to assemble the main body with the connection seat, a latch section being disposed on a bottom of the connection seat.

22. The shift assembly structure of the switch device as claimed in claim 17, wherein when the push/press section pushes the restriction section, the inclined face of the push/press section pushes the inclined section of the restriction section to a horizontal position to force the stop wall of the restriction section to leave the ridge section into an unlocked state.

23. The shift assembly structure of the switch device as claimed in claim 22, wherein the main body receives therein an operation section, the main body has a shaft section and channels formed on the shaft section, the assembling hole of the connection seat having a wall formed with multiple insertion blocks, the shaft section of the main body being passable through the assembling hole of the connection seat with the insertion blocks of the assembling hole positioned in the channels so as to assemble the main body with the connection seat, a latch section being disposed on a bottom of the connection seat.

24. The shift assembly structure of the switch device as claimed in claim 17, wherein the main body receives therein an operation section, the main body has a shaft section and channels formed on the shaft section, the assembling hole of the connection seat having a wall formed with multiple insertion blocks, the shaft section of the main body being passable through the assembling hole of the connection seat with the insertion blocks of the assembling hole positioned in the channels so as to assemble the main body with the connection seat, a latch section being disposed on a bottom of the connection seat.

* * * * *